US008607863B2

(12) United States Patent
Fripp et al.

(10) Patent No.: US 8,607,863 B2
(45) Date of Patent: Dec. 17, 2013

(54) SYSTEM AND METHOD FOR DOWNHOLE COMMUNICATION

(75) Inventors: Michael L. Fripp, Carrollton, TX (US); Donald Kyle, Plano, TX (US); Pete Dagenais, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1106 days.

(21) Appl. No.: 12/574,993

(22) Filed: Oct. 7, 2009

(65) Prior Publication Data

US 2011/0079386 A1 Apr. 7, 2011

(51) Int. Cl.
*E21B 47/00* (2012.01)
*E21B 47/12* (2012.01)

(52) U.S. Cl.
CPC ..... *E21B 47/12* (2013.01)
USPC ..... 166/250.01; 166/255.1; 166/66

(58) Field of Classification Search
USPC ..... 166/250.01, 255.1, 250.15, 66; 175/45
See application file for complete search history.

(56) References Cited

U.S. PATENT DOCUMENTS

| | | | | |
|---|---|---|---|---|
| 3,638,235 | A | 1/1972 | Lindsey | |
| 4,041,780 | A | 8/1977 | Angehrn | |
| 4,102,394 | A * | 7/1978 | Botts | 166/66 |
| 5,038,614 | A * | 8/1991 | Bseisu et al. | 73/592 |
| 5,377,540 | A | 1/1995 | Songe, Jr. et al. | |
| 5,429,190 | A | 7/1995 | Kilgore et al. | |
| 5,456,316 | A | 10/1995 | Owens et al. | |
| 5,558,153 | A | 9/1996 | Holcombe et al. | |
| 5,850,879 | A | 12/1998 | Smith | |
| 5,908,365 | A | 6/1999 | LaJaunie et al. | |
| 6,070,672 | A | 6/2000 | Gazda | |
| 6,151,961 | A | 11/2000 | Huber et al. | |
| 6,199,628 | B1 | 3/2001 | Beck et al. | |
| 6,318,463 | B1 | 11/2001 | Fehrmann et al. | |
| 6,389,890 | B1 | 5/2002 | Sweetland et al. | |
| 6,536,519 | B1 | 3/2003 | Vaynshteyn et al. | |
| 6,608,565 | B1 * | 8/2003 | Van Steenwyk et al. | 340/855.4 |
| 6,710,720 | B2 | 3/2004 | Carstensen et al. | |
| 6,945,330 | B2 | 9/2005 | Wilson et al. | |

(Continued)

FOREIGN PATENT DOCUMENTS

| | | | |
|---|---|---|---|
| GB | 2447336 | A | 9/2008 |
| WO | 2004013457 | A2 | 2/2004 |

(Continued)

OTHER PUBLICATIONS

King, James, et al., "An improved method of slickline perforating," SPE 81536, 2003, pp. 1-4, Society of Petroleum Engineers Inc.

(Continued)

*Primary Examiner* — Cathleen Hutchins
(74) *Attorney, Agent, or Firm* — Scott Wendorf; Conley Rose, P.C.

(57) ABSTRACT

A method of servicing a wellbore extending from a surface and penetrating a subterranean formation is provided. The method comprises placing a workstring in the wellbore, wherein the workstring comprises at least a first downhole tool, a signal receiver subassembly, and a conveyance between the first downhole tool and the surface. The method further comprises the signal receiver subassembly receiving a first signal generated by contact between the wellbore and the workstring and initiating a first function of the first downhole tool based on the first signal.

24 Claims, 4 Drawing Sheets

(56) References Cited

U.S. PATENT DOCUMENTS

| | | | | |
|---|---|---|---|---|
| 7,053,787 | B2 | 5/2006 | Schultz et al. | |
| 7,224,289 | B2 | 5/2007 | Bausov et al. | |
| 7,775,285 | B2 | 8/2010 | Surjaatmadja et al. | |
| 8,191,623 | B2 | 6/2012 | Lynde et al. | |
| 8,322,426 | B2 | 12/2012 | Wright et al. | |
| 2003/0010492 | A1 * | 1/2003 | Hill et al. | 166/65.1 |
| 2007/0007016 | A1 | 1/2007 | Sanderlin | |
| 2009/0078413 | A1 | 3/2009 | Tubel et al. | |
| 2010/0175867 | A1 | 7/2010 | Wright et al. | |
| 2011/0139445 | A1 | 6/2011 | Fripp et al. | |
| 2011/0174504 | A1 | 7/2011 | Wright et al. | |

FOREIGN PATENT DOCUMENTS

| | | | |
|---|---|---|---|
| WO | 2007008637 | A1 | 1/2007 |
| WO | 2008085059 | A1 | 7/2008 |
| WO | 2011043981 | A2 | 4/2011 |
| WO | 2011043981 | A3 | 4/2011 |
| WO | 2012082774 | A2 | 6/2012 |
| WO | 2012082774 | A3 | 6/2012 |

OTHER PUBLICATIONS

Schlumberger product information, "eFire-Slickline electronic firing head," http://www.slb.com/content/services/perforating/slickline/efire_slickline.asp?, Sep. 29, 2009, 1 page, Schlumberger Limited.

Schlumberger brochure entitled, "eFire-Slickline electronic firing head system," May 2002, 8 pages, Schlumberger.

Schlumberger brochure entitled, "eFire-Slickline firing head," 2008, 2 pages, Schlumberger.

Schlumberger brochure entitled, "eFire-TCP firing system," Apr. 2007, 2 pages, Schlumberger.

Patent application entitled "Well tools operable via thermal expansion resulting from reactive materials," by Adam D. Wright, et al., filed Jan. 15, 2010 as U.S. Appl. No. 12/668,058.

Patent application entitled "Downhole actuator apparatus having a chemically activated trigger," by Adam D. Wright, et al., filed Apr. 28, 2010 as U.S. Appl. No. 12/768,927.

Patent application entitled "System and method for downhole communication," by Michael L. Fripp, et al., filed Dec. 15, 2010 as U.S. Appl. No. 12/969,379.

Foreign communication from a related counterpart application—International Search Report and Written Opinion, PCT/US2011/064699, Jul. 30, 2012, 7 pages.

Foreign communication from a related counterpart application—International Preliminary Report on Patentability, PCT/US2010/050963, Apr. 11, 2012, 8 pages.

Foreign communication from a related counterpart application—International Search Report and Written Opinion, PCT/US2010/050963, Sep. 23, 2011, 10 pages.

Office Action dated Apr. 18, 2013 (25 pages), U.S. Appl. No. 12/969,379, filed Dec. 15, 2010.

* cited by examiner

SYSTEM AND METHOD FOR DOWNHOLE COMMUNICATION

CROSS-REFERENCE TO RELATED APPLICATIONS

None

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

A variety of servicing operations may be performed on a wellbore after it has been initially drilled. A lateral junction may be set in the wellbore at the intersection of two lateral wellbores and/or at the intersection of a lateral wellbore with the main wellbore. A casing string may be set and cemented in the wellbore. A liner may be hung in the casing string. The casing string may be perforated by firing a perforation gun. A packer may be set and a formation proximate to the wellbore may be hydraulically fractured. A plug may be set in the wellbore. Those skilled in the art may readily identify additional wellbore servicing operations. In many servicing operations, a downhole tool is conveyed into the wellbore to accomplish the needed wellbore servicing operation, for example by some triggering event initiating one or more functions of the downhole tool. Controlling the downhole tool from the surface presents many challenges, and a variety of technical solutions have been deployed.

SUMMARY

In an embodiment, a method of servicing a wellbore extending from a surface and penetrating a subterranean formation is disclosed. The method comprises placing a workstring in the wellbore, wherein the workstring comprises at least a first downhole tool, a signal receiver subassembly, and a conveyance between the first downhole tool and the surface. The method further comprises the signal receiver subassembly receiving a first signal generated by contact between the wellbore and the workstring and triggering a first function of the first downhole tool based on the first signal.

In another embodiment, a method of servicing a wellbore extending from a surface and penetrating a subterranean formation is disclosed. The method comprises, placing a workstring in the wellbore, wherein the workstring comprises at least one downhole tool, a trigger unit subassembly, and a conveyance string between the downhole tool and the surface.

The method further comprises analyzing an indication of a velocity of the workstring in the wellbore as it changes over time to decode a discrete signal encoded by the motion of the workstring in the wellbore. A first discrete value of the discrete signal is associated with an amplitude of the indication of the velocity of the workstring above a first threshold and a second discrete value of the discrete signal is associated with an amplitude of the indication of the velocity of the workstring less than a second threshold, where the second threshold is less than the first threshold. The method also comprises, when the discrete signal matches a trigger number, triggering a function of the downhole tool by the trigger unit subassembly.

In another embodiment, a method of servicing a wellbore extending from a surface and penetrating a subterranean formation is disclosed. The method comprises placing a workstring in the wellbore, wherein the workstring comprises at least a downhole tool, a signal receiver subassembly, and a conveyance between the downhole tool and the surface. The method also comprises receiving by the signal receiver subassembly an acoustic signal generated by motion of the workstring relative to the wellbore and initiating a function of the downhole tool based on the acoustic signal.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Figure 1:
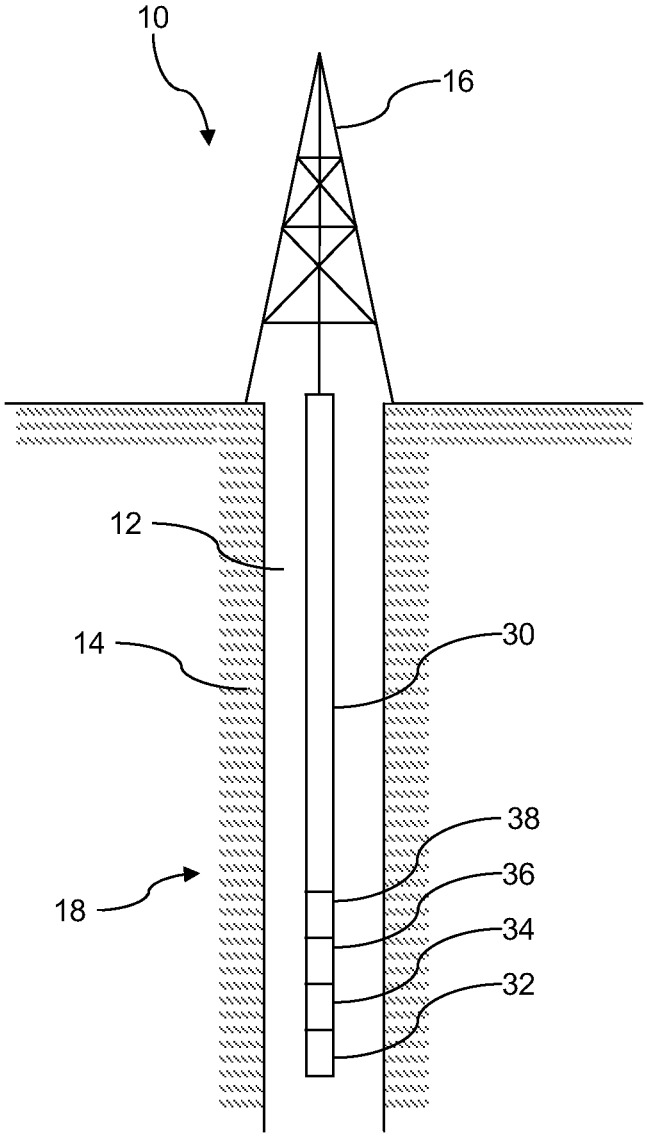
FIG. 1 is an illustration of a workstring according to an embodiment of the disclosure.

Turning now to FIG. 1, a wellbore servicing system 10 is described. The system 10 comprises servicing rig 16 that extends over and around a wellbore 12 that penetrates a subterranean formation 14 for the purpose of recovering hydrocarbons. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The servicing rig 16 may be one of a drilling rig, a completion rig, a workover rig, or other mast structure and supports a workstring 18 in the wellbore 12, but in other embodiments a different structure may support the workstring 18. In an embodiment, the servicing rig 16 may comprise a derrick with a rig floor through which the workstring 18 extends downward from the servicing rig 16 into the wellbore 12. In some embodiments, such as in an off-shore location, the servicing rig 16 may be supported by piers extending downwards to a seabed. Alternatively, in some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude sea water and contain drilling fluid returns. It is understood that other mechanical mechanisms, not shown, may control the run-in and withdrawal of the workstring 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 18 may comprise a conveyance 30, a first downhole tool 32, and a signal receiver subassembly 34. The conveyance 30 may be any of a string of jointed pipes, a slickline, a coiled tubing, and a wireline. In another embodiment, the workstring 18 may further comprise a second downhole tool 36, while in yet other embodiments the workstring may comprise additional downhole tools. In an embodiment, the workstring 18 further comprises a mechanical vibration source 38. In some contexts, the workstring 18 may be referred to as a tool string. The signal receiver subassembly 34, in combination with other components depicted in FIG. 1, may provide an efficient, reliable, and user friendly communication downlink from the surface to the downhole tools 32, 36. It is understood that the downhole tools 32, 36, the signal receiver subassembly 34, and/or the mechanical vibration source 38 may be utilized in vertical, horizontal, curved, inverted, or inclined orientations without departing from the teachings of the present disclosure. In an embodiment, the signal receiver subassembly 34 may be incorporated into and/or integrated with one of the downhole tools 32, 36. For example, in an embodiment, the signal receiver subassembly 34 and the first downhole tool 32 may share one or more of a housing, a power supply, a memory, a processor, and/or other components.

In some embodiments, the wellbore 12 may be lined with a casing (not shown) that is secured into position against the subterranean formation 14 in a conventional manner using cement. In an embodiment, the downhole tools 32, 36 and/or the workstring 18 may be moving through a tubing that is located within the casing.

When the first downhole tool 32 has been run-in to a target depth in the wellbore 12, to activate and/or trigger performance of a first function by the first downhole tool 32, a signal is communicated from the surface to the signal receiver subassembly 34, and the signal receiver subassembly 34 then triggers the first function of the first downhole tool 32. The present disclosure teaches communicating the signal from the surface by manipulating the workstring 30 in the wellbore 12. For example, the signal may comprise a discrete signal that is encoded as a sequence of different velocities. In an embodiment, a velocity in excess of a first defined threshold, either uphole or downhole, may encode a first discrete value, and a velocity less than the first defined threshold, either uphole or downhole, may encode a second discrete value. Alternatively, in another embodiment, a velocity in excess of the first defined threshold, either uphole or downhole, may encode the first discrete value, and a velocity less than a second defined threshold, where the second defined threshold is less than the first defined threshold, either uphole or downhole, may encode a second discrete value. In some circumstances, using two different thresholds may increase the reliability of downhole communication. In an embodiment, the first discrete value may be a $0_2$ and the second discrete value may be a $1_2$. Alternatively, in another embodiment, the first discrete value may be a $1_2$ and the second discrete value may be a $0_2$. In an embodiment, the thresholds may be adaptive and may change in the downhole environment in response to mechanical vibration and/or mechanical noise levels, signal levels, the previous signal path, the rate of change of the signal amplitude, and other downhole environment parameters. In another embodiment, the discrete signal may be encoded as a sequence of different rotational velocities, a sequence of different axial velocities, or a sequence comprised of a combination of two or more of different linear velocities, different rotational velocities, and different axial velocities.

In another embodiment, a greater amount of information may be encoded in the motion of the workstring 18. For example, a third discrete value may be encoded by a velocity amplitude less than a third defined threshold, a fourth discrete value may be encoded by a velocity amplitude greater than a fourth defined threshold and less than a fifth defined threshold, a fifth discrete value may be encoded by a velocity amplitude greater than a sixth defined threshold and less than a seventh defined threshold, and a sixth discrete value may be encoded by a velocity amplitude greater than an eighth defined threshold, where the velocity amplitude disregards the sense of direction of the velocity. In an embodiment, the third discrete value may be $00_2$, the fourth discrete value may be $01_2$, the fifth discrete value may be $10_2$, and the sixth discrete value may be $11_2$. Those skilled in the art will appreciate that other similar encodings are possible, all of which are contemplated by the present disclosure. By manipulating the workstring 18 at the surface in a sequence of up and down motions or in a sequence of rotational movements, a multiple digit discrete number may be communicated to the signal receiver subassembly 34.

While the discussion above was directed to digital communication employing a binary base or a base 2 encoding scheme, in an embodiment, a different base of numerical representation may be employed, for example the signals may be encoded in base 3. A $0_3$ value could be encoded by no movement, a $1_3$ value could be encoded by a downhole movement, and a $2_3$ value could be encoded by an uphole movement. Appropriate bounding thresholds may likewise be defined for such a base 3 representation system to provide excluded values to decrease the probability of erroneous signal transmissions. One skilled in the art will readily appreciate that other numerical bases may be employed to encode the communication signals, all of which are contemplated by the present disclosure.

It has been observed that relying on accelerating the workstring 18 uphole-downhole and/or encoding the communication to the signal receiver subassembly 34 in a sequence of accelerations of the workstring 18 uphole-downhole may become unreliable when the workstring 18 is of great length, as for example in a deep well or in a lateral wellbore that accesses a production zone displaced a considerable distance away from the main wellbore. This may result from the large mechanical spring and damper properties associated with the workstring 18 when it becomes long. The settling time of the workstring 18 is longer for a longer workstring 18. For example, manipulation of the workstring 18 at the surface to impart a controlled acceleration to the workstring 18 uphole-downhole may result in a different acceleration at the signal receiver subsystem 34, as the acceleration is altered by mechanical spring and damper effects. Additionally, relying upon uphole-downhole accelerations, which in some contexts may be referred to as gross accelerations to distinguish from the minor displacements of accelerations associated with mechanical vibrations, to communicate to the signal receiver subassembly 34 may be sensitive to precise axial alignment of an accelerometer with the workstring 18. Due to the high costs involved in servicing wellbores and/or delays of putting a well on production, reliability is an important consideration in designing a downhole communication apparatus.

In an embodiment, the signal receiver subassembly 34 may comprise one or more velocity sensors. The velocity sensors may be one or more of a flow velocity transducer, fluid flow transducer, a rolling wheel transducer, an optical scanner, a magnetic field transducer, a ferroelectric transducer, a gamma ray transducer, and other transducers effective for producing an indication of a velocity of the signal receiver subassembly 34 and/or other components of the workstring 18. In an embodiment, the velocity sensors may additionally comprise one or more of a gravitational sensor, a magnetic field sensor, or a pressure sensor. Alternatively, rather than the signal receiver subassembly 34 comprising the velocity sensor, the velocity sensor may be a separate subassembly in the workstring 18 that is communicatively coupled to the signal receiver subassembly 34.

In an embodiment, the velocity sensor and/or sensors detect a velocity of the workstring 18 proximate to the first downhole tool 32 and communicate this value to the signal receiver subassembly 34. In some embodiments, the velocity sensor may communicate a value that is an analog of the velocity of the workstring 18, which may be referred to as an indication of velocity, to the signal receiver subassembly 34, and the signal receiver subassembly 34 may process this value to determine and/or calculate the velocity of the workstring 18 based on the value. In other embodiments, the velocity sensor may communicate a value that is an analog of the displacement and/or position of the workstring 18 in the wellbore 12 to the signal receiver subassembly 34, and the signal receiver subassembly 34 may process this value and/or a sequence of these values to determine and/or calculate the velocity of the workstring 18 based on the value and/or values. In an embodiment, the indications of motion provided by one or more of a gravitational sensor, magnetic field sensor, and a pressure sensor may also be processed and used in combination with other indications to calculate the velocity of the workstring 18. In an embodiment, the velocity of the workstring 18 may not be calculated or determined, and the indication of velocity may be used to decode the signal transmitted from the surface.

In an embodiment, the signal receiver subassembly 34 processes the velocity of the workstring 18 to decode the signal communicated from the surface. Decoding the signal communicated from the surface may involve one or more of a variety of signal processing and/or signal conditioning operations comprising, but not limited to, sensing and/or transducing a physical quality or phenomenon into an electrical signal, analog to digital conversion of the signal, optionally frequency filtering the electrical signal, determining a discrete number in the electrical signal, and comparing the discrete number to one or more stored numbers, which in some contexts may be referred to as trigger numbers, to determine that activation of a selected function of one or more of the downhole tools has been commanded. In an embodiment, the mechanical signal experienced by the workstring 18 and/or the signal receiver subassembly 34 may be mechanically filtered by mechanical mechanisms coupled to the workstring 18. Mechanical filtering may be performed by spring and/or damper materials coupled to and/or enclosing the workstring 18 and/or the signal receive subassembly 34.

Velocity is distinguished from acceleration in a variety of ways. Mathematically, acceleration is the first derivative of velocity. A constant velocity, uphole or downhole or rotationally, corresponds to a zero acceleration value. Practically speaking, in some circumstances it is easier to impart and maintain a controlled, reliable velocity to the workstring 18 proximate to the first downhole tool 32 than to impart and maintain a controlled, reliable acceleration to the workstring 18 proximate to the first downhole tool 32, for example when the workstring 18 is long and large spring and damper effects are involved at the point in the workstring 18 proximate to the first downhole tool 32, for example where an acceleration sensor may be located. It may be easier to establish and maintain a standard velocity for an interval of time—for example for five seconds—than to maintain a standard acceleration for the same interval of time.

In another embodiment, the signal receiver subassembly 34 may infer the velocity of the workstring 18 proximate to the first downhole tool 32 based on a sensed amplitude of a mechanical vibration incident upon the workstring 18 proximate to the first downhole tool 32. In some contexts, the mechanical vibration may be referred to as a mechanical noise. In some contexts, the mechanical vibration may be referred to as road noise, by analogy with the general rumble heard in the interior of a wheeled vehicle traveling over the road. In some contexts, the mechanical vibration may be referred to as an acoustic signal. Acoustic signals and/or acoustic energy may be characterized as propagating substantially as a longitudinal wave. The motion of the workstring 18 proximate to the first downhole tool 32 in the wellbore 12 may produce mechanical vibrations and/or mechanical noise, for example as the outer surface of the workstring 18 contacts and rubs against the wellbore 12. The mechanical vibrations produced by motion of the workstring 18 in the wellbore 12 may be substantially similar whether the workstring 18 is moving uphole, downhole, clockwise, or counter-clockwise. In an embodiment, an asymmetrical motion profile may be induced in the workstring 18 to produce vibrations that have a different amplitude and/or frequency based on the direction of travel of the workstring 18.

In an embodiment, the discrete signal described above may be generated by contact between the wellbore 12 and the workstring 18, wherein the contact that generates the discrete signal is created predominantly by axial motion of the workstring 18 in the wellbore 12 (e.g., motion substantially parallel to the axis of the workstring 18). In another embodiment, the discrete signal described above may be generated by contact between the wellbore 12 and the workstring 18, wherein the contact that generates the discrete signal is created predominantly by rotational motion of the workstring 18 in the wellbore 12. The alignment of the motion of the workstring 18 may or may not correlate with the alignment of the mechanical vibration energy and/or mechanical noise and/or road noise detected by the signal receiver subassembly 34.

In some circumstances, manipulating the workstring 18 proximate to the surface to induce the mechanical vibration and/or mechanical noise may be a more robust and reliable communication signal than the acceleration of the workstring 18. For example, in a deep wellbore, the acceleration of the workstring 18 at the surface may be substantially altered by the large spring and damper effects associated with the great length of the workstring 18. For example, an acceleration impulse at the surface may be reduced in amplitude and spread in time at a point in the workstring 18 proximate to the first downhole tool 32.

In an embodiment, the digital signal communicated from the surface may be framed by time intervals. For example, the digital signal may be composed of an ordered sequence of digital symbols, where each digital symbol is communicated within a specific time interval. For, example, but not by way of limitation, the digital signal may be communicated in a series of 20 second time intervals where the digital signal is determined during a central portion of the subject time interval or during an end portion of the subject time interval. By ignoring the value during an initial portion of the subject time interval, the workstring 18 may have an opportunity to reach a constant velocity before the digital symbol is received by the signal receiver subassembly 34, thereby allowing spring and damper effects to settle out and allowing gross acceleration to approach zero. In an embodiment, a 20 second symbol period may be employed, and the digital symbol may be received during the time interval from 8 seconds after the start of the symbol period to 12 seconds after the start of the symbol period. In another embodiment, the 20 second symbol period may be employed, and the digital symbol may be received during the timer interval from 14 seconds after the start of the symbol period to 18 seconds after the start of the symbol period. In other embodiments, a different length of symbol period may be employed and the digital symbol may be sampled and/or received at a different point within the symbol period. In an embodiment, a frame synchronization signal may be communicated from the surface before sending the digital signals to the signal receiver subassembly 34, for example a known sequence of 1's and 0's to permit the signal receiver subassembly 34 to adjust its sense of time intervals with that of the surface.

In an embodiment, the signal receiver subassembly 34 may comprise one or more mechanical vibration sensors. The mechanical vibration sensors may be one or more of an accelerometer, a voice coil, a piezoceramic transducer, a magnetostrictive sensor, a ferroelectric transducer, and a strain gauge. Alternatively, rather than the signal receiver subassembly 34 comprising the mechanical vibration sensor, the mechanical vibration sensor may be a separate subassembly in the workstring 18 that is communicatively coupled to the signal receiver subassembly 34. The mechanical vibration sensor and/or sensors detect the amplitude of the mechanical vibration of the workstring 18 proximate to the downhole tool 32 and communicates this value to the signal receiver subassembly 34, and the signal receiver subassembly 34 processes the value to decode the signal communicated from the surface.

In an embodiment, the mechanical vibration sensor may be an accelerometer and may be oriented substantially radially and/or perpendicularly with reference to the axis of the workstring 18. It is thought that the mechanical vibration associated with movement of the workstring 18 in the wellbore 12 is substantially radially oriented and substantially orthogonal to the axis of the workstring 18. At the same time, it is also thought that the energy of the mechanical vibration associated with movement of the workstring 18 in the wellbore 12 is distributed, at least in part, in all orientations, thereby making the function of the accelerometer for sensing this mechanical vibration relatively insensitive to precise orientation of the accelerometer.

In an embodiment, the mechanical vibration source 38 may be incorporated into the workstring 18. The mechanical vibration source 38 then moves with the workstring 18 and produces mechanical vibration and/or mechanical noise in response to motion of the mechanical vibration source 38 in the wellbore 12. The mechanical vibration source 38 may provide either a more consistent mechanical vibration or a mechanical vibration having particular properties, for example a mechanical vibration having particular frequency properties or having a particular alignment and/or orientation. In an embodiment, the signal receiver subassembly 34 may be designed and/or programmed to identify the particular frequency that the mechanical vibration source 38 is designed to enhance, for example, the signal receiver subassembly 34 may perform frequency selective filtering to exclude and/or attenuate frequencies outside the main frequency bandwidth of the mechanical vibration frequency generated by the mechanical vibration source 38 and to pass the frequencies in the main frequency bandwidth of the mechanical vibration generated by the mechanical vibration source 38. This may contribute to fewer spurious signals being interpreted by the signal receiver subassembly 34 as valid communication symbols from the surface. The mechanical vibration source 38 may comprise at least one of an extended probe, a wheel that actuates a mechanical noise maker, a rattle, a revolving member, a propeller, a workstring centralizer, a workstring decentralizes, and other like mechanical contrivances for promoting mechanical vibrations and/or mechanical noise and/or an acoustic signal.

In an embodiment, the signal receiver subassembly 34 may process the sensed mechanical vibration through a high pass filter to attenuate the low frequency components of the mechanical vibration. In an embodiment, the high pass filter may be implemented as an analog filter comprised of inductive, resistive, and capacitive elements. Alternatively, in another embodiment, the high pass filter may be implemented as a digital filter. The signal receiver subassembly 34 or another component of the workstring 18 may convert the mechanical vibration or acoustic signal to an electrical signal and process the electrical signal through the high pass filter to produce a filtered electrical signal. Alternatively, in an embodiment, the electrical signal may be converted to a digital signal and the digital signal may be processed by a high pass digital filter to produce a filtered digital signal. In an embodiment, the high pass filter may have a cut-off frequency of about 10 Hertz (Hz). The cut-off frequency of the high pass filter may be the point where low frequency components of the sensed mechanical vibration are attenuated by at least 3 decibels (dB). In another embodiment, however, the high pass filter may have a cut-off frequency of about 50 Hz. In another embodiment, the high pass filter may have a cut-off frequency of about 200 Hz. In another embodiment, the high pass filter may have a cut-off frequency of about 500 Hz. In an embodiment, the high pass filter is configured to pass audio frequencies and to attenuate and/or reject sub-audio frequencies. The audio frequency band is associated with the frequency band from 20 Hz to 20,000 Hz by some. Others associate the audio frequency band with a narrower frequency band, for example from about 50 Hz to 16,000 Hz. Yet others may associate the audio frequency band with a yet narrower frequency band, for example from about 100 Hz to about 12,000 Hz.

In some initial testing, it appears that a significant amount of the energy of the sensed mechanical vibration associated with motion of the workstring 18 in the wellbore 12 is concentrated in the audio frequency range. More particularly, a significant amount of the energy of the sensed mechanical vibration associated with the motion of the workstring 18 in the wellbore 12 is located above about 500 Hz. It has been found that the energy of the sensed mechanical vibration that can be ascribed to a variety of events unrelated to motion of the workstring 18 uphole and downhole in the wellbore 12, which may be referred to as spurious events, is concentrated in the sub-audio frequency range, for example below 10 Hz. Additionally, the energy of the sensed mechanical vibration that can be ascribed to gross acceleration of the workstring 18 is also concentrated in the sub-audio frequency range. The present disclosure teaches setting the cut-off frequency of the high pass filter at a frequency that is effective to attenuate and/or reject the sensed mechanical vibration associated with spurious events and gross accelerations while passing the sensed mechanical vibration associated with motion of the workstring 18 uphole and downhole in the wellbore 12. An example of a spurious event is a momentary collision of a collar or a joint between subassemblies in the workstring 18 with a protrusion in the wellbore 12. In an embodiment, the signal receiver subassembly 34 may be said to detect a frequency generated by contact of the workstring 18 and/or the first downhole tool 32 with the wellbore 12 to determine a trigger for the first downhole tool 32.

In an embodiment, the signal receiver subassembly 34 high pass filters the sensed mechanical vibration, which may be referred to as a source signal, to produce a first derived signal. In an embodiment, the signal receiver subassembly 34 may produce the first derived signal by bandpass filtering the mechanical vibration to attenuate frequencies below a first cutoff frequency and to attenuate frequencies above a second cutoff frequency, where the second cutoff frequency is higher than the first cutoff frequency, for example when the mechanical vibration source 38 enhances the energy of mechanical vibration within the pass band of the bandpass filter. The signal receiver subassembly 34 may rectify and/or calculate the absolute value of the first derived signal to produce a second derived signal. The second derived signal may be considered to be an energy signal. The signal receiver subassembly 34 may average and/or low pass filter the second derived signal to produce a third derived signal. The signal receiver subassembly 34 may threshold detect the third derived signal to produce a fourth derived signal. The signal receiver subassembly 34 may process the fourth derived signal to generate the binary ones and zeroes of the transmitted binary number or values of the transmitted signals in some other discrete number system. In an alternative embodiment, some of the processing described above may be omitted. In yet another embodiment, some of the processing described above as occurring separately and/or sequentially may be combined and/or may be performed in a different sequence from that described above.

The signal receiver subassembly 34 processes either the sensed velocity or the sensed mechanical vibration of the workstring 18 proximate to the first downhole tool 32 to receive the signal transmitted from the surface, for example a multi-digit discrete number. For example, a velocity value greater than a threshold value may be decoded as a first binary value while a velocity value less than the threshold value may be decoded as a second binary value. Alternatively, a mechanical vibration value greater than a threshold value may be decoded as a first binary value and a mechanical vibration value less than the threshold value may be decoded as a second binary value. Note that while the mechanical vibration may be used to infer a velocity of the workstring 18 proximate to the first downhole tool 32, in at least some embodiments the signal receiver subassembly 34 need not convert the sensed mechanical vibration to an equivalent velocity to decode the binary signal transmitted from the surface, and the signal receiver subassembly 34 may decode the binary signal directly based on the sensed mechanical vibration. Without limitation of the present disclosure, providing a communication down link from the surface to the downhole tools 32, 36 and/or the signal receiver subassembly 34 based on mechanical vibration is expected to have particular advantages in inclined and/or horizontal wellbores 12, where there is a natural tendency of the workstring 18 to contact and rub against the wellbore 12 on the side attracted by the earth's gravitational field, thereby establishing a distinct and ample mechanical vibration.

The signal receiver subassembly 34 compares the received discrete number to a trigger number, for example a binary number that was programmed or configured into the signal receiver subassembly 34 before deploying downhole in the workstring 18. When the signal receiver subassembly 34 determines that the received discrete number matches the trigger number, the signal receiver subassembly 34 communicates a triggering signal, a triggering command, and/or an actuation signal to the first downhole tool 32. The first downhole tool 32 then activates and performs the subject function in response to receiving the triggering signal from the signal receiver subassembly 34. In some contexts, the signal receiving subassembly 34 may be referred to as a trigger unit or a trigger subassembly.

In an embodiment, the signal receiver subassembly 34 may be configured with a plurality of different trigger numbers. In this case, the signal receiver subassembly 34 may selectively activate different functions of the first downhole tool 32 and/or functions performed by different downhole tools. For example, in an embodiment, a first trigger number may be associated with a first function of the first downhole tool 32 and a second trigger number may be associated with a second function of the first downhole tool 32. In another embodiment, a third trigger number may be associated with a third function of the first downhole tool 32 and a fourth trigger number may be associated with a fourth function of the second downhole tool 36.

The trigger number may have any number of discrete digits. Increasing the number of discrete digits in the trigger number has the effect of increasing the reliability and robustness of the communication downhole but has the drawback of increasing the complexity of manipulating the workstring 18 at the surface to transmit the signal downhole. In combination with the present disclosure, one skilled in the art will readily determine an effective number of discrete digits from which to compose the trigger number, based in part on experience and the special operating conditions of the subject well bore servicing system 10. In an embodiment, the trigger number may be configured into the signal receiver subassembly 34 by a wired and/or a wireless link to a computer or mobile handset at the location of the system 10, at a depot shop, or at a laboratory. In an embodiment, the configuration of the trigger number(s) into the signal receiver subassembly 34 may include an optional or a mandatory step of erasing the memory location for storing trigger numbers, to avoid any possibility of leaving obsolete trigger numbers active in the signal receiver subassembly 34.

The downhole tools 32, 36 may be one of a packer, a bridge plug, a perforation gun, a flow control device, a sampler, a setting tool, a sensing instrument, a data collection device and/or instrument, and other downhole tools. The functions of the downhole tools 32, 36 that the signal receiver subassembly 34 may activate may comprise any of initiating detonation of a perforation gun, deploying a setting tool, starting collection of data, stopping collection of data, starting transmission of data, stopping transmission of data, and others. The downhole tools 32, 36 may promote a variety of wellbore services including, but not by way of limitation, cementing, hydraulic fracturing, acidizing, gravel packing, setting tools, setting lateral junctions, perforating casing and/or formations, collecting data, transmitting data, drilling, and other services.

In an embodiment, the signal receiver subassembly 34 may receive an indication of an environmental parameter, for example temperature and/or pressure, for example from one or more environment sensors incorporated into the workstring 18. The signal receiver subassembly 34 may enable and/or disable outputting the triggering signal to the downhole tools 32, 36 based on the value of the environmental parameters. For example, the signal receiver subassembly 34 may disable outputting the triggering signal to the downhole tools 32, 36 when the sensed temperature exceeds 700 degrees Fahrenheit, for example during a fire. As another example, the signal receiver subassembly 34 may disable outputting the triggering signal when the sensed pressure is less than 10 atmospheres, for example to avoid outputting an erroneous triggering signal while the downhole tools 32, 36 are not deployed sufficiently far into the wellbore 12.

In an embodiment, the downhole tools 32, 36 may be triggered and/or activated by a shared signal receiver subassembly 34. Alternatively, in an embodiment, the workstring 18 may comprise a plurality of signal receiver subassemblies 34, for example one signal receiver subassembly per downhole tool and/or one signal receiver subassembly per distinct function to be triggered. In an embodiment, the signal receiver subassemblies 34 may communicate with the downhole tool 32, 36 by a variety of communication means including, but not limited to, wireless communication, wired communication, acoustic telemetry, pressure pulse communication, and other. In an embodiment, the signal receiver subassembly 34 comprises a computer in a sealed inner chamber. Computers are discussed in more detail hereinafter.

Figure 2:
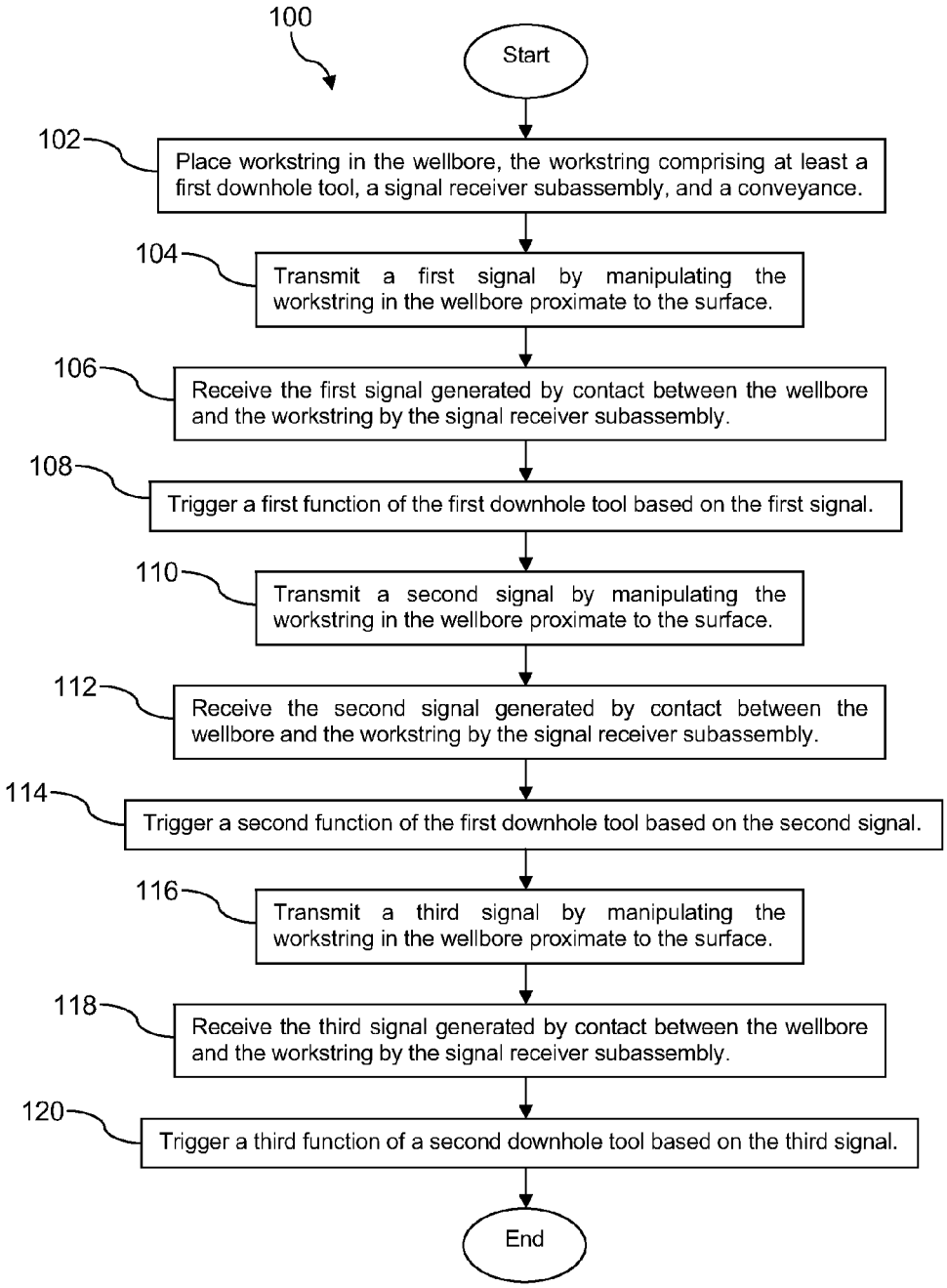
FIG. 2 is a flow chart of a method according to an embodiment of the disclosure.

Turning now to FIG. 2, a method 100 is described. At block 102, the workstring 18 is placed in the wellbore 12. The workstring 18 comprises at least the first downhole tool 32, the signal receiver subassembly 34, and the conveyance 30. In an embodiment, placing the workstring 18 in the wellbore 12 may include the steps of assembling and/or making up the workstring 18 from the several components, for example coupling the first downhole tool 32, the signal receiver subassembly 34, and the conveyance 30 together. In an embodiment, the conveyance 30 may comprise a number of joints of pipe, and placing the workstring 18 in the wellbore 12 may further comprise threadingly coupling the joints of pipe together to make up the conveyance 30. As described above, however, the conveyance 30 may alternatively comprise slickline, wireline, or coiled tubing. In an embodiment, placing the workstring 18 in the wellbore 12 may include configuring one or more trigger numbers into the signal receiving subassembly 34. Placing the workstring 18 in the wellbore 12 may comprise running-in the first downhole tool 32 to a target depth for performing a wellbore servicing operation using the first downhole tool 32.

At block 104, a first signal is transmitted by manipulating the workstring 18 in the wellbore 12 proximate to the surface. For example, a draw works coupled to a hoisting apparatus supported by the servicing rig 16 may move the workstring 18 uphole during a first time interval to transmit a first discrete value, for example a $1_2$ discrete value. The draw works may hold the workstring 18 substantially steady during a second time interval to transmit a second discrete value, for example a $0_2$ discrete value. Note that to encode two successive discrete values having the same value, the draw works may move the workstring 18 uphole substantially continuously or hold the workstring 18 steady during two discrete symbol intervals. In an embodiment, moving the workstring 18 uphole or downhole may encode the same discrete value. Alternatively, in an embodiment, other associations of motion and/or mechanical vibration to discrete values may be employed. For example, to encode two successive discrete values having the same value, the draw works may move the workstring 18 uphole for a period of time, pause to denote the end of the first bit, and then move the workstring 18 uphole for a second period of time.

In an embodiment, a different base of numerical representation may be employed, for example the signals may be encoded in base 3. A $0_3$ value could be encoded by no movement, a $1_3$ value could be encoded by a downhole movement, and a $2_3$ value could be encoded by an uphole movement. One skilled in the art will readily appreciate that, likewise, other numerical bases may be employed to encode the communication signals, all of which are contemplated by the present disclosure.

In some embodiments, moving the workstring 18 in the wellbore 12 to transmit the first discrete value means moving the workstring 18 with at least a threshold velocity uphole or downhole, and holding the workstring 18 steady in the wellbore 12 to transmit the second discrete value means keeping the uphole and downhole velocity of the workstring 18 less than a threshold velocity. The first signal is transmitted by manipulating the workstring 18 in the wellbore 12 to send a sequence of discrete values. It is understood that, in an embodiment, transmitting the first signal is understood to comprise generating mechanical vibration proximate the first downhole tool 32 at least in part by moving contact between portions of the workstring 18 and the wellbore 12. In another embodiment, transmitting the first signal is understood to comprise generating an acoustic signal by motion of the workstring 18 relative to the wellbore 12. In an embodiment, before transmitting the first signal, the workstring 18 may be manipulated in the wellbore 12 proximate to the surface to sending a framing signal, for example a regular pattern of 1's and 0's, to promote the signal receiving subassembly 34 synchronizing to the discrete symbol frame time being observed at the surface.

At block 106, the first signal is received by the signal receiver subassembly 34. In an embodiment, the first signal may be received by the signal receiver subassembly 34 as at least one of an indication of velocity of the workstring 18 proximate to the first downhole tool 32 and an indication of the mechanical vibration incident upon the first downhole tool 32. In some contexts it may be said that the first signal is generated by contact between the workstring 18 and the wellbore 12. In another embodiment, however, contact between the workstring 18 and the wellbore 12 is not required to generate an acoustic signal that may be relied upon to decode the signal transmitted from the surface.

At block 108, a first function of the first downhole tool 32 is triggered based on the first signal. For example, the signal receiver subassembly 34 receives the first signal, decodes the discrete number contained in the first signal, compares the discrete number to the trigger value configured into the signal receiver subassembly 34, determines a match between the discrete number and the trigger value, and communicates the triggering signal to the first downhole tool 32 to actuate a first function of the first downhole tool 32, for example to initiate detonation of a perforation gun.

In blocks 110, 112, and 114, optionally, a second signal is transmitted, the second signal is received, and a second function of the first downhole tool 32 is actuated similarly to blocks 104, 106, and 108 above. In an embodiment, the signal receiver subassembly 34 may be configured with a plurality of trigger numbers linked to specific functions and/or specific downhole tools 32, 36. When the second signal is decoded and determined to contain a second trigger value associated with a second function of the first downhole tool 32, the signal receiver subassembly 34 communicates the triggering signal to the first downhole tool 32 to actuate the second function of the first downhole tool 32.

In blocks 116, 118, and 120, optionally, a third function of the second downhole tool 36 is actuated by communication from the signal receiver subassembly 34 similarly to blocks 110, 112, and 114. After a desired number of functions of one or more downhole tools have been triggered in a manner similar to that described above, the method 100 then exits.

Figure 3:
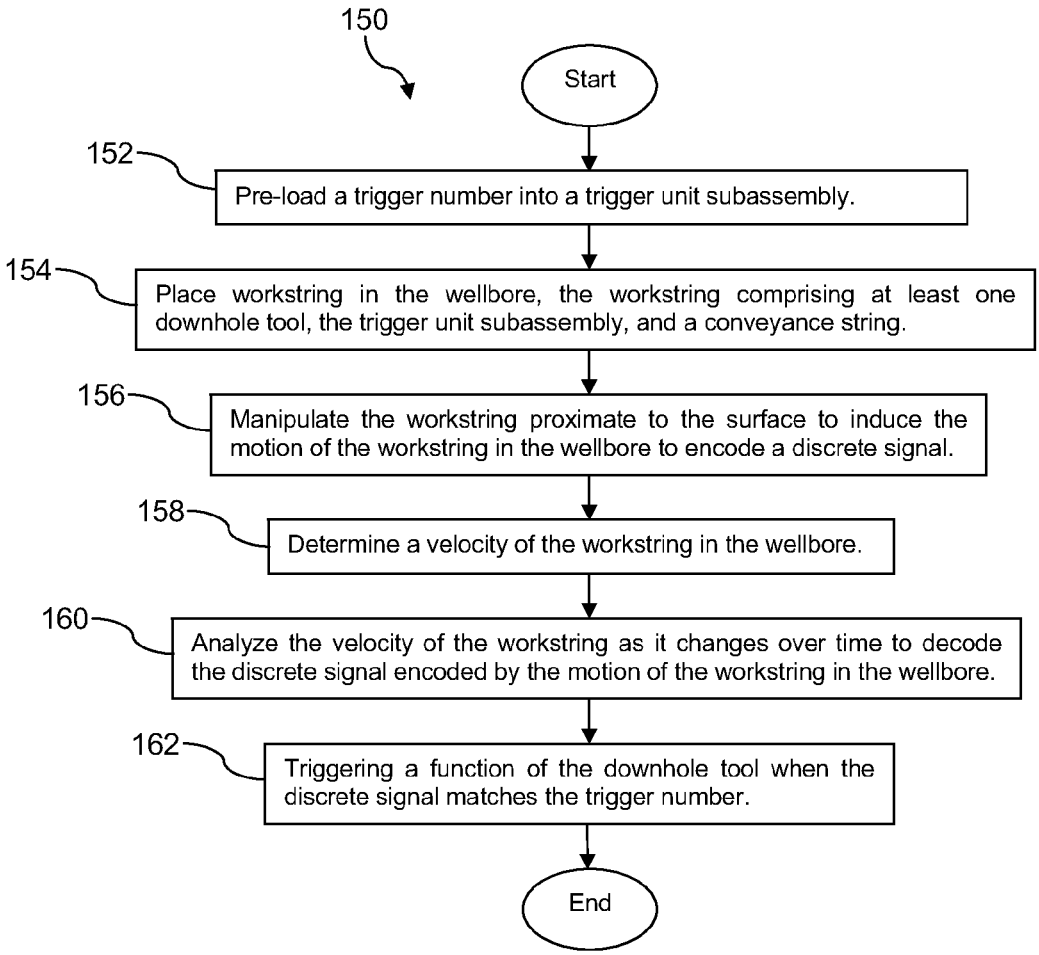
FIG. 3 is a flow chart of another method according to an embodiment of the disclosure.

Turning now to FIG. 3, a method 150 is described. At block 152, a trigger number is pre-loaded and/or configured into a trigger unit subassembly, for example into the signal receiver subassembly 34. This step may include configuring a plurality of trigger numbers, each associated with a specific function and/or a specific downhole tool 32, 36. At block 154, the workstring 18 is placed in the wellbore 12, substantially similarly to block 102 described above with reference to FIG. 2. At block 156, the workstring 18 is manipulated proximate to the surface to induce motion in the workstring 18 in the wellbore to encode a discrete signal and/or a discrete number.

At block 158, a velocity of the workstring 18 proximate to the first downhole tool 32 is determined. For example, the trigger unit subassembly receives indications of the velocity of the workstring 18 from velocity sensors, processes the indications, and determines a velocity of the workstring 18. At block 160, the trigger unit subassembly analyzes the velocity of the workstring 18 as it changes over time to decode the discrete signal encoded in the motion imparted to the workstring 18 by manipulation at the surface. In an embodiment, the processing of block 158 and block 160 may be combined. Alternatively, the processing of block 158 and block 160 may loop and/or iterate during receiving of the discrete signal.

At block 162, a function of the downhole tool 32 is triggered by the triggering unit subassembly based on the discrete signal, for example based on the discrete number encoded in the discrete signal matching the trigger number configured in the triggering unit subassembly. The processing of blocks 156, 158, 160, and 162, optionally, may be repeated a desired number of times to trigger functions of other downhole tools. The method 150 then exits.

Figure 4:
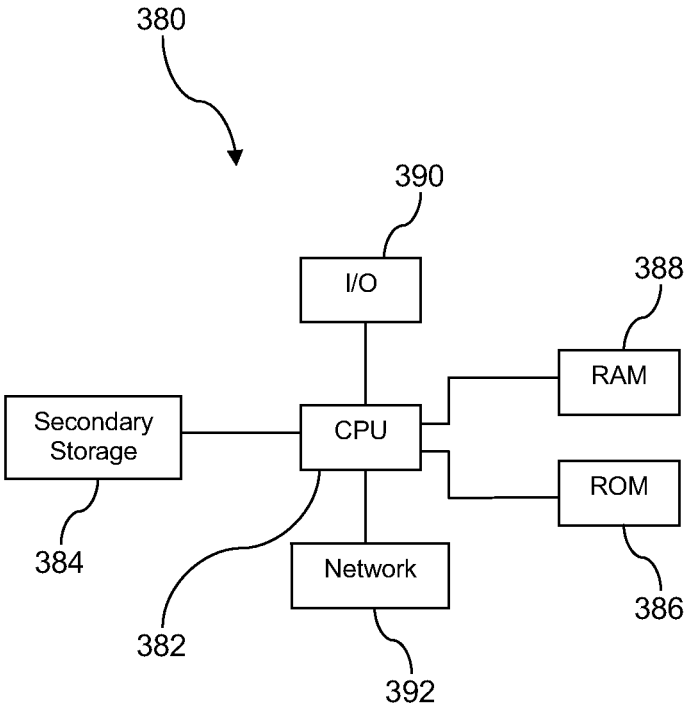
FIG. 4 is an illustration of a computer system suitable for implementing the several embodiments of the disclosure.

FIG. 4 illustrates a computer system 380 suitable for implementing one or more embodiments disclosed herein. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), and/or worldwide interoperability for microwave access (WiMAX) radio transceiver cards, and other well-known network devices. These network connectivity devices 392 may enable the processor 382 to communicate with an Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embodied in the carrier wave generated by the network connectivity devices 392 may propagate in or on the surface of electrical conductors, in coaxial cables, in waveguides, in optical media, for example optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, referred to herein as the transmission medium, may be generated according to several methods well known to one skilled in the art.

The processor 382 executes instructions, codes, computer programs, scripts which it accesses from hard disk, floppy disk, optical disk (these various disk based systems may all be considered secondary storage 384), ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of servicing a wellbore extending from a surface and penetrating a subterranean formation, comprising:

placing a workstring in the wellbore, wherein the workstring comprises at least a first downhole tool, a signal receiver subassembly, and a conveyance between the first downhole tool and the surface, wherein the first down hole tool and the signal receiver subassembly are coupled to a downhole end of the conveyance;

transmitting a first velocity signal by axially moving the workstring in the wellbore proximate to the surface, wherein transmitting the first velocity signal comprises axially moving the workstring to transmit a first discrete value and maintaining the workstring stationary to transmit a second discrete value and wherein the first velocity signal encodes a first discrete number as a sequence of discrete values;

receiving by the signal receiver subassembly the first velocity signal generated by contact between the wellbore and the workstring proximate to the first downhole tool; and initiating a first function of the first downhole tool based on the first velocity signal.

2. The method of claim 1, further comprising:

transmitting a second velocity signal, the second velocity signal generated by contact between the wellbore and the workstring by axially moving the workstring in the wellbore proximate to the surface, wherein the second velocity signal encodes a second discrete number that is distinct from the first discrete number;

receiving by the signal receiver subassembly the second velocity signal; and initiating a second function of the first downhole tool based on the second velocity signal.

3. The method of claim 1, wherein the workstring further comprises a second downhole tool, further comprising:

transmitting a third velocity signal, the third velocity signal generated by contact between the wellbore and the workstring by axially moving the workstring in the wellbore proximate to the surface, wherein the third velocity signal encodes a third discrete number, the third discrete number distinct from the first discrete number;

receiving by the signal receiver subassembly the third velocity signal; and initiating a third function of the second downhole tool based on the third velocity signal.

4. The method of claim 1, further comprising:

sensing an environmental parameter, wherein the environmental parameter is one of temperature or pressure; and inhibiting the initiating the first function of the first downhole tool based on the environmental parameter.

5. The method of claim 4, wherein the first function of the down hole tool is inhibited from initiation when a sensed temperature exceeds 700 degrees Fahrenheit.

6. The method of claim 4, wherein the first function of the down hole tool is inhibited from initiation when a sensed pressure is less than 10 atmospheres.

7. The method of claim 1, further comprising filtering the first velocity signal to substantially reject sub-audio frequency components of the first velocity signal, wherein initiating the first function of the first downhole tool is based on the filtered first velocity signal.

8. The method of claim 7, wherein the filtering of the first velocity signal substantially rejects frequency components of the first velocity signal having a frequency less than about 500 Hertz.

9. The method of claim 1, wherein the first downhole tool comprises one of a packer, a bridge plug, a perforation gun, a flow control device, a sampler, and a setting tool.

10. The method of claim 1, wherein the conveyance comprises at least one of a string of pipe joints, a wireline, a slickline, and coiled tubing.

11. The method of claim 1, wherein the signal receiver subassembly further comprises a velocity sensor to sense the first velocity signal.

12. The method of claim 11, wherein the velocity sensor comprises at least one of an accelerometer, a voice coil, a piezoceramic transducer, a magnetostrictive sensor, a strain gauge, and a ferroelectric transducer.

13. The method of claim 1, wherein the workstring further comprises a mechanical velocity source configured to induce at least a portion of the mechanical velocity when the workstring moves in the wellbore.

14. The method of claim 13, wherein the mechanical velocity source is at least one of an extended probe, a revolving member, workstring centralizer, and a workstring decentralizer.

15. The method of claim 1, further comprising configuring the first discrete number into the signal receiver subassembly.

16. A method of servicing a wellbore extending from a surface and penetrating a subterranean formation, comprising:

placing a workstring in the wellbore, wherein the workstring comprises at least a first downhole tool, a signal receiver subassembly, a conveyance between the first downhole tool and the surface, and a mechanical vibration source configured to induce a mechanical vibration when the workstring moves in the wellbore, wherein the first downhole tool, the signal receiver subassembly, and the mechanical vibration source are coupled to a downhole end of the conveyance;

transmitting a first velocity signal by axially moving the workstring in the wellbore proximate to the surface, wherein transmitting the first velocity signal comprises axially moving the workstring to transmit a first discrete value and maintaining the workstring stationary to transmit a second discrete value and wherein the first velocity signal encodes a first discrete number as a sequence of discrete values;

receiving by the signal receiver subassembly the first velocity signal, wherein the signal receiver infers the first velocity signal from a mechanical vibration generated by contact between the wellbore and the workstring proximate to the first downhole tool; and initiating a first function of the first downhole tool based on the first velocity signal.

17. The method of claim 16, wherein the mechanical vibration source is configured to produce a consistent mechanical vibration.

18. The method of claim 16, wherein the mechanical vibration source is an extended probe.

19. The method of claim 16, wherein the mechanical vibration source is a revolving member.

20. A method of servicing a wellbore extending from a surface and penetrating a subterranean formation, comprising:

placing a workstring in the wellbore, wherein the workstring comprises at least a first downhole tool, a signal receiver subassembly, a conveyance between the first downhole tool and the surface, and a mechanical vibration source configured to induce a mechanical vibration having a selected main frequency bandwidth when the workstring moves in the wellbore, wherein the first down hole tool, the signal receiver subassembly, and the mechanical vibration source are coupled to a downhole end of the conveyance;

transmitting a first velocity signal by axially moving the workstring in the wellbore proximate to the surface, wherein transmitting the first velocity signal comprises moving the workstring to transmit a first discrete value and maintaining the workstring stationary to transmit a second discrete value and wherein the first velocity signal encodes a first discrete number as a sequence of discrete values;

receiving by the signal receiver subassembly the first velocity signal, wherein the signal receiver infers the first velocity signal from a mechanical vibration generated by contact between the wellbore and the workstring proximate to the first downhole tool; and initiating a first function of the first downhole tool based on the first velocity signal.

21. The method of claim 20, wherein the mechanical vibration source is an extended probe.

22. The method of claim 20, wherein the mechanical vibration source is a revolving member.

23. The method of claim 20, wherein the mechanical vibration source is further configured to provide a consistent mechanical vibration.

24. The method of claim 23, wherein the mechanical vibration source is further configured to produce a mechanical vibration having a selected alignment.

* * * * *